United States Patent [19]

Deutsch et al.

[11] 4,442,747

[45] Apr. 17, 1984

[54] OCTAVE PHASE DECOUPLING IN AN ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instrument Mfg. Co., Ltd., Hamamatsu, Japan

[21] Appl. No.: 377,118

[22] Filed: May 11, 1982

[51] Int. Cl.[3] ..... G10H 1/00

[52] U.S. Cl. ..... 84/1.01; 84/1.22; 84/1.24

[58] Field of Search ..... 84/1.01, 1.24, DIG. 2, 84/1.19, 1.22

[56] References Cited

U.S. PATENT DOCUMENTS 3,809,786 5/1974 Deutsch ..... 84/1.01

4,186,637 2/1980 Swain et al. ..... 84/DIG. 2

4,386,546 6/1983 Fritz et al. ..... 84/1.24

*Primary Examiner*—Forester W. Isen

*Attorney, Agent, or Firm*—Ralph Deutsch

[57] ABSTRACT

Apparatus is described to control the starting phase of a new tone for a keyboard operated electronic musical instrument having a number of tone generators. An interval detection subsystem is used to determine if a new note is separated by a given musical interval, such as an octave, from a currently generated musical tone. If the prespecified separation is detected the new tone generator is initialized so that its starting waveshape phase is equal to that of its related interval neighbor. Provision is incorporated to shift the new tone generator by a random frequency offset to phase unlock the octave intervals.

10 Claims, 4 Drawing Figures

NOTE DETECT AND ASSIGNOR
131
KEYSWITCH SCANNER
130
KEYBOARD SWITCHES
13
KEYSWITCH STATE DETECTOR
184
NOTE COUNTER (MODULO 12)
64
MEMORY ADDRESS DATA WRITE
83
MASTER CLOCK
56
84
60
COMPARATOR
105
ASSIGNMENT MEMORY
82
CLOCK COUNTER (MODULO 12)
66
EQUAL
106
ONE OFF
COMPARATOR
102
GROUP COUNTER
57
LATCH
103
AR
F/F
S
R
Q
104
CONTROL
HALT INC
RESET
LATCH
101
AP
WRITE

OCTAVE PHASE DECOUPLING IN AN ELECTRONIC MUSICAL INSTRUMENT

BACKGROUND OF THE INVENTION

1. Field of the Invention

This invention relates to electronic keyboard operated musical instruments and in particular is concerned with the starting phase assigned to generated tones.

2. Description of the Prior Art

Electronic musical instruments all too frequently are designed with tonal characteristics which differ with related tonal characteristics associated with either a single acoustical musical instrument or with a small group of acoustical musical instruments. It is virtually impossible for a group of such musical instruments to initiate their tones all at the same relative phase. On the other hand, the mechanical-like tone generators of many electronic keyboard musical instruments provide a ready means for initiating all tones with a precise common relative phase.

The majority of current commercially available electronic musical instruments use a tone generation system that has been given the generic name of "top octave synthesizer." In these instruments the 12 top octave musical note frequencies are generated by means of counters which count down from a single master clock at prescribed integer ratios. The remainder of the keyboard frequencies are obtained by a sequence of counters which divide by 2,4,8,16.... It is a characteristic of a top octave synthesizer that the octaves are locked in phase in the sense that the fundamental of a note is in phase with the second harmonic of a note an octave below the first note. Systems having this phase characteristic of octavely related notes is said to have "locked octaves."

A positive attribute of musical instruments having phase locked octaves is that when two notes are played at an octave spacing, the resultant tone increases in loudness as a simple sum because there is no phase cancelation of harmonics. A strong negative attribute of phase locked octaves is that the result of two octavely related notes is a steady tone which completely lacks the beating effect characteristic of playing two acoustic musical instruments. It is this beating effect that provides a desired "warmth" to the ensemble tone of a combination of musical instruments. If two acoustical instruments happen to initiate their individual tones either exactly in phase or exactly out of phase, the initial phase situation is short-lived because of the lack of precise tuning of the instruments and because of the center frequency instability that is characteristic of most acoustical musical instruments.

Attempts have been made to decouple, or unlock, the octaves in electronic musical instruments by employing a frequency generating system that deliberately detunes each keyboard note by a set of predetermined frequency errors. While such systems provide a satisfactory steady state ensemble effect they do not address the problem of a random initial phase associated with the actuation of a keyboard switch. If the frequency error is made large enough to rapidly change the relative phases of the generated tones then one may find that the out-of-tuneness can be more objectionable than the tonal effect produced by locked octaves.

SUMMARY OF THE INVENTION

In a keyboard operated electronic musical instrument having a linear array of keyswitches a note detect and assign system is employed to detect changes in the keyswitch states by means of key scanning signals. A member of a plurality of note generators is assigned to each actuated keyswitch thereby creating a musical tone at a fundamental pitch corresponding to the keyswitch. Logic is used to determine if a newly actuated keyswitch differs by an octave from a previously assigned tone generator. If an octave difference is detected, a new tone generator is assigned and the starting phase of its tone is phase locked to the waveshape produced by the tone generator which is already operating at the octave interval. An added degree of realism is obtained by using a random number generator to create a frequency offset for the new note so that the waveshape starts in phase but is detuned from that produced by the octavely related previously assigned tone generator.

It is an object of the present invention to cause octavely related notes to start in phase, the starting phase condition being independent of the relative time interval between the actuation of the respective keyswitches.

It is a further object of the present invention to detune octavely related notes without detuning all the other keyboard notes.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a subsystem for initiating a newly assigned tone generator so that its generated waveshape is started in phase with that produced by a tone generator creating a musical waveshape at an octave spacing from the new tone.

Figure 1:
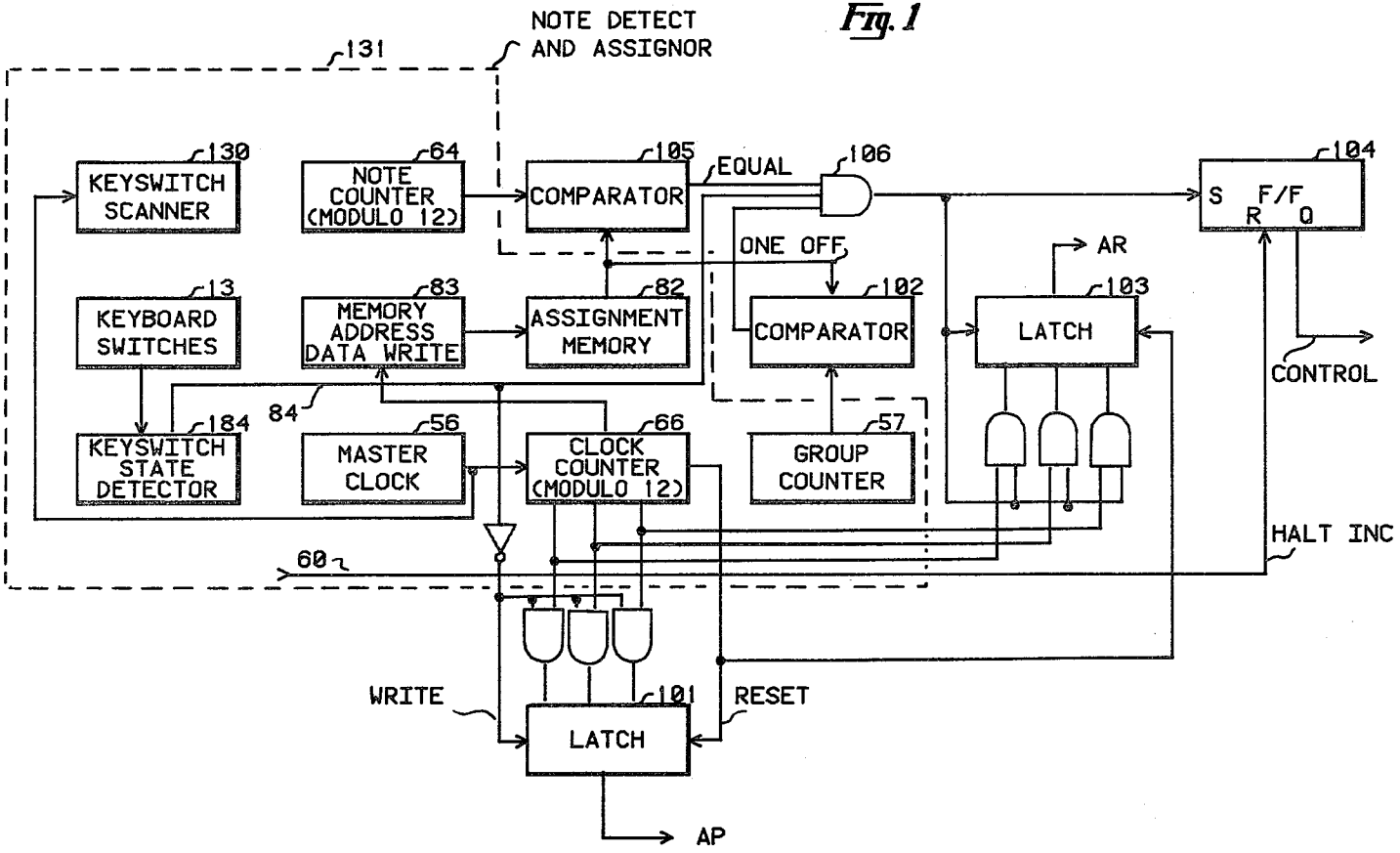
FIG. 1 illustrates the octave spacing logic.

FIG. 1 illustrates the subsystem logic that determines if a new note is at an octave relation with a note produced by a previously assigned tone generator. The note detect and assignor 131 serves to scan an array of keyboard keyswitches, in a sequence of keyswitch scans, to determine the switch states of the individual keyswitches. The keyswitches are operable in either an actuated state (switch closed) or an unactuated state (switch open). A suitable implementation for a note detect and assignor system is described in U.S. Pat. No. 4,022,098 entitled "Keyboard Switch Detect And Assignor." This patent is hereby incorporated by reference. The system described in the referenced patent is used for illustrative purposes, it being understood that other note detect and assign systems can also be used in conjunction with the present invention. In the following description all the elements of the system which are described in the above referenced patent are identified by two digit numbers which correspond to the same numbered elements appearing in the reference patent. All system element blocks which are identified by three digit numbers correspond to system elements added to implement the improvements of the present invention.

A HALT INC signal, also called a detection signal, is generated on line 60 if the note detect and assignor 131 has detected a keyboard switch which is now actuated but was not actuated on the immediate prior scan of the array of keyboard switches. The HALT INC signal is used to reset the flip-flop 104 so that its output binary logic state is Q="0".

A binary logic "1" signal is placed on line 84 by the note detect and assignor if the current data word addressed out from the assignment memory 82 corresponds to a tone generator that has been previously assigned. A binary logic "0" on line 84 indicates that the current data word addressed out from the assignment memory 82 corresponds to an unassigned tone generator.

Each time that a logic "0" signal appears on line 84, the current state of the clock counter 66 is stored in the latch 101. This "0" signal is called the WRITE signal since it causes data to be written into the latch 101. Stored data words are read out of the assignment memory 82 in response to the count states of the clock counter 66. Each time that the clock counter 66 returns to its initial count state because of its modulo counting implementation a RESET signal is generated. In response to this RESET signal, the data stored in the latch 101 is reset to an initial zero state value.

The remainder of the logic shown in FIG. 1 that is added to the note detect and assignor 131 serves to determine if the new note register address portion of the data word stored in the latch 101 is to be used to phase match the new note to be generated at the time at which the corresponding new tone generation is initiated. This condition, if detected, the signified as described below by the output binary state Q of the flip-flop 104.

Comparator 105 will generate an EQUAL signal if the current note data information read out from the assignment memory 82 corresponds to the note data identifying the current scanned keyswitch as represented by the count state of the note counter 64. As described in the referenced U.S. Pat. No. 4,022,098, the count state of the note counter 64 corresponds to the musical note within a musical octave of the current note switch scan of the note detect and assignor 131 when it is in its assign mode.

The comparator 102 is used to compare the current state of the group counter 57 with the octave data portion of the note data word currently addressed out from the assignment memory 82. As described in the referenced U.S. Pat. No. 4,022,098 the count states of the group counter 57 correspond to the octaves of the keyboard currently being scanned by the note detect and assignor 131. The comparator 102 will generate a ONE OFF signal if the count state of the group counter 57 is either +1 or −1 from the octave data portion of the note data word addressed out from the assignment memory 82.

The net result of combining the EQUAL and ONE OFF signals is that the output of AND-gate 106 will be a binary logic state "1" at the time a new actuated keyswitch is detected and if the corresponding new note differs by one octave from a note that has already been assigned to a tone generator. The flip-flop 104 is set in response to a binary logic state "1" output from the AND-gate 106. The output binary state Q of the flip-flop 104 is used as a CONTROL signal.

At the same time that the flip-flop is set, the "1" signal output from the AND-gate 106 causes the latch 103 to store the current count state of the clock counter 66. The content of the latch 103 is reset to a zero initial value by the RESET signal generated each time that the clock counter 66 returns to its initial count state because of its modulo counting implementation.

The net result of the previously described system operation is that at the time the CONTROL signal is generated by setting the flip-flop 104, latch 103 will contain the assignment memory address of a previously assigned tone generator which has a fundamental frequency that differs by one octave (plus or minus) from the assignment memory address stored in the latch 101 corresponding to a new assigned tone generator.

The memory address data stored in the latch 101 and latch 103 in conjunction with the CONTROL signal can be used in a variety of implementations to control the frequency and starting phase of the new musical tone. Advantageously a suitable system can be implemented by a modification of the system described in U.S. Pat. No. 4,256,003 entitled "Note Frequency Generator For An Electronic Musical Instrument." This patent is hereby incorporated by reference.

Figure 2:
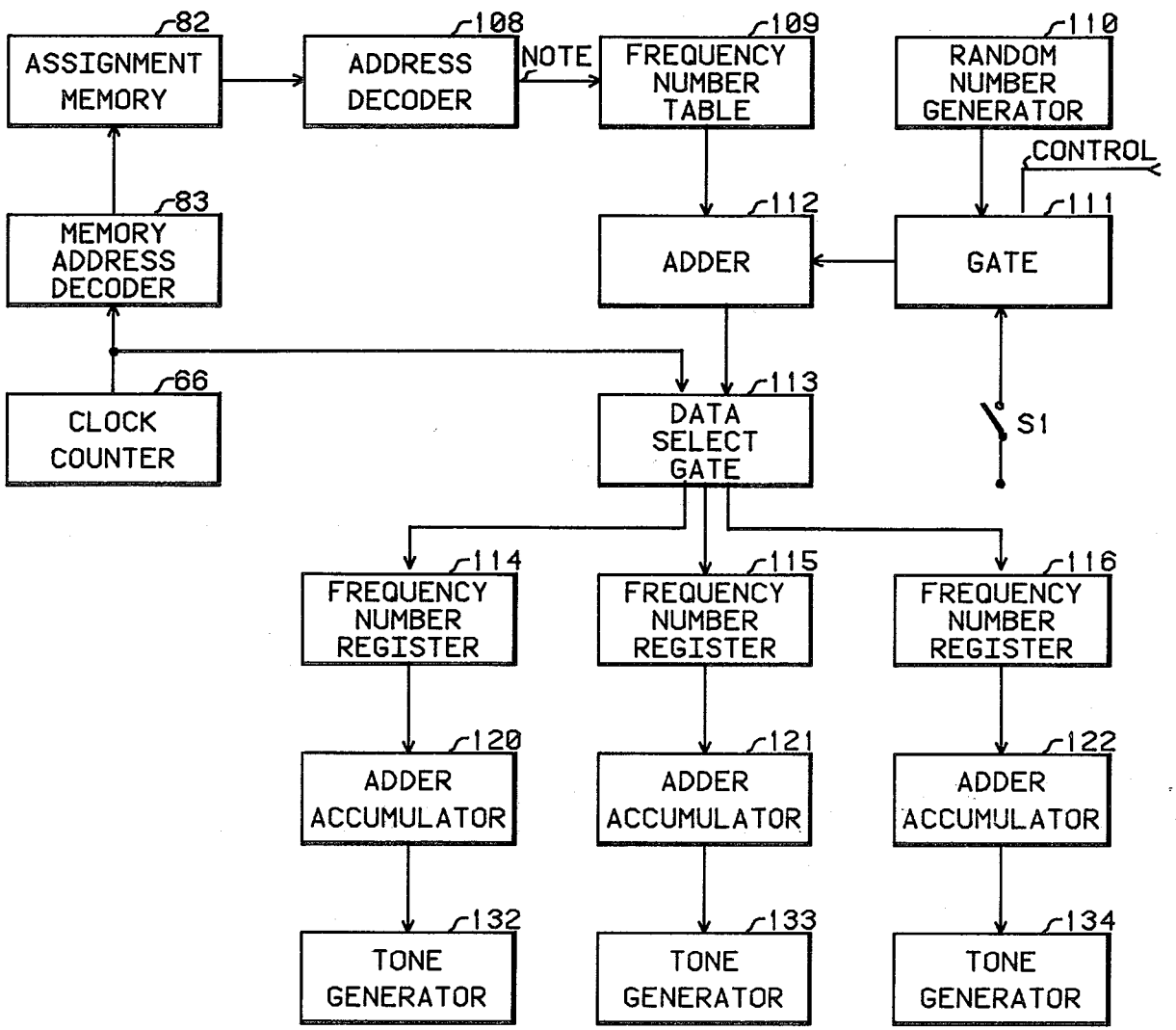
FIG. 2 illustrates the frequency assignment logic.

FIG. 2 illustrates the system for assigning frequencies to a set of tone generators. Assigned note data values are read out of the assignment memory 82 in response to the count state of the clock counter 66. As described in the referenced U.S. Pat. No. 4,022,098, a detection signal is encoded into a note data value comprising 10 binary bits. The least significant bit (#1) denotes the assignment status of the corresponding tone generator. Each word stored in the assignment memory 82 corresponds to one of the set of available tone generators. Bits 2, 3, 4 designate the group counter 57 state, or equivalently, these bits designate the octave number within a keyboard (instrument's keyboard division). Bits 5, 6 designate the instrument's keyboards. Bits 7, 8, 9, 10 correspond to the count state of the note counter 64 and denote the musical note within a musical octave.

Address decoder 108 uses bits 7, 8, 9 and 10 of the accessed noted data word from the assignment memory 82 to address out a frequency number stored in the frequency number 109. The frequency number table 109 is a read-only addressable memory containing frequency numbers in binary numeric form having the values $2^{(-N/12)}$ where N has the range of values N=1,2, . . . , M and M is equal to the number of keyswitches on a keyboard of the musical instrument. The frequency numbers represent the ratios of the fundamental frequencies in an equal tempered musical scale. Each frequency number table address corresponds to a musical note and to a frequency number. Thus a difference in frequency table address numbers corresponds to a ratio of frequencies.

The random number generator 110 generates a random sequence of binary numbers which can be used to detune the new note if it differs by an octave from a frequency currently assigned to a member of the set of tone generators. Octave detuning is selected by actuating switch S1. If switch S1 is actuated (on position) then the gate 111 will transfer a random number from the random number generator 110 in response to the CONTROL signal.

Adder 112 is used to add the random number, if any, transferred by the gate 111 to the frequency number read out of the frequency number table 109. The frequency numbers from the adder 112 are transferred to the set of frequency number registers 114–116 under control of the data select gate 113. Data select gate 113 transfers the frequency number from the adder 112 to a note frequency register which corresponds to the current count state of the clock counter 66. Each of the tone generators has a corresponding frequency number register. Each tone generator uses the frequency number value stored in its frequency number register to control the fundamental frequency of the generated musical tone.

Figure 3:
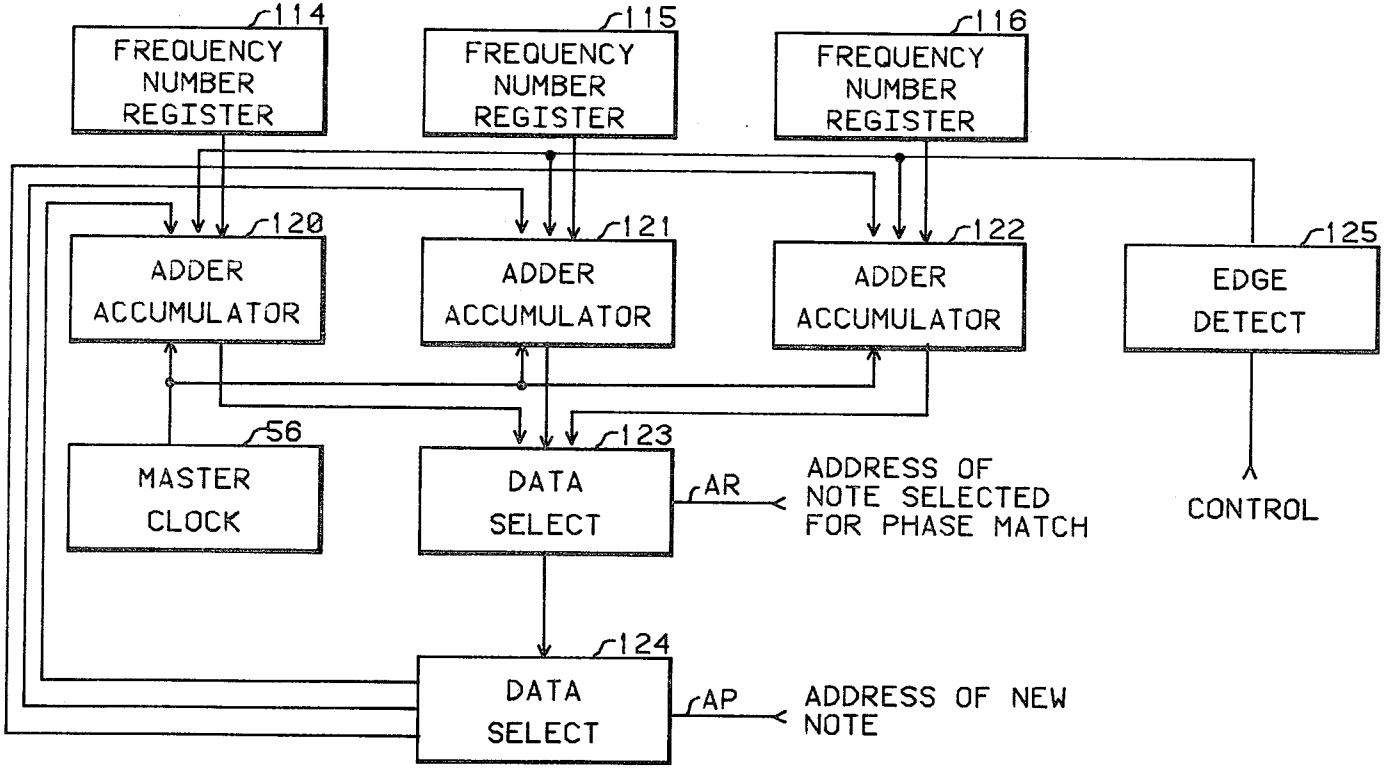
FIG. 3 illustrates the phase initializing system logic.

FIG. 3 illustrates the system logic for initializing the starting phase of a new note if it differs in frequency by one octave from the frequency of a currently assigned tone generator.

The set of adder-accumulators 120, 121 and 122 successively add a frequency number from their corresponding frequency number registers to the contents of their accumulators, at a preselected clock rate as furnished by the master clock 56. This type of non-integer frequency divider operation is described in U.S. Pat. No. 4,256,003 entitled "Note Frequency Generator For An Electronic Musical Instrument." This patent is hereby incorporated by reference. The data value contained in the accumulator of each of the set of adder-accumulators is used to read out stored musical waveshape data points contained in each of the corresponding tone generators. As shown in FIG. 2, each tone generator has a corresponding adder-accumulator.

The data values accumulated in each member of the set of adder-accumulators is transferred to form a set of input data values to the data select 123. Data select 123 selects one of the input data values in response to the address value on line AR and transfers the selected value to the data select 124. The address value on line AR, as described previously, corresponds to a tone generator that is currently assigned and is operating at a frequency that differs by one octave from the new note that is to be assigned.

The data select 124 transfers its input data value on to one of a set of output data lines in response to the address value on line AP. As described previously, the address value on line AP corresponds to a new note which is assigned a frequency differing by one octave from a presently assigned tone generator.

Each of the output data lines from the data seleect 124 is connected as a data input line to one member of the set of adder-accumulators 120–122.

The edge detect 125 converts the CONTROL signal into a signal control pulse-like signal. In response to a signal output from the edge detect 125, the adder-accumulator selected by the data select 124 in response to the address data on line AP will have the value in its accumulator set equal to the current value in the accumulator corresponding to a tone generator operating of the octave frequency spacing.

In the fashion described above, if the new note differs by an octave from a currently assigned tone generator, the assigned new tone generator will start its waveshape generation in phase with its octave neighbor. If the frequency error mode has been selected, then the octavely related notes will not remain in their initial phase locked relation and will generate the type of beat frequencies that are characteristic of acoustic music instruments played in an ensemble.

It is an obvious extension of the present invention to produce an initial phase lock for notes separated at any specified musical interval in a manner analogous to the detailed logic described for an octave interval.

Figure 4:
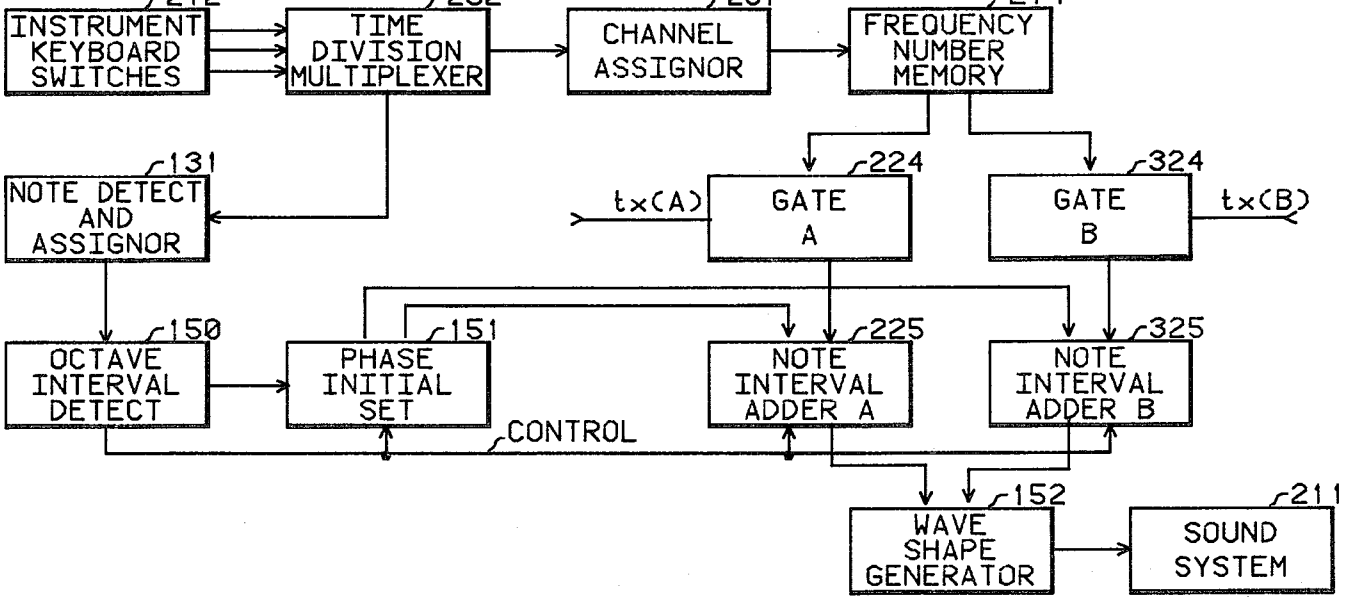
FIG. 4 illustrates the invention imbedded in the Computer Organ tone generation system.

The present invention can also be incorporated into other tone generation systems. FIG. 4 illustrates the application of the present invention to the tone generation system described in U.S. Pat. No. 3,809,786 entitled "Computor Organ." This patent is hereby incorporated by reference. The system blocks having labels in the 200 series correspond to the same system elements shown in the figures of U.S. Pat. No. 3,809,786 having a number which is 200 less than those shown here in FIG. 4. FIG. 4 is a modification of the system shown in FIG. 6 of U.S. Pat. No. 3,809,786.

As described in the referenced patent, the output of the channel assignor 281 addresses out frequency numbers from the frequency number memory 214 in response to keyswitches that are actuated in the instrument keyboard switches 212. The frequency numbers addressed out from the frequency number member 214 are each successively added to the content of a note interval adder 255 A and B at ech computation time $t_x(A)$ and $t_x(B)$. The note interval adder corresponds in function to the adder-accumulators 120–122 shown in FIG. 3 of the present invention.

The contents of the note interval adders 245 A and B are furnished to the wave shape generator 152. In the fashion described in U.S. Pat. No. 3,809,786, the waveshape generator computes a succession of points which are converted into analog signals and furnished to the sound system 211.

The waveshape generator operates by computing a discrete Fourier transform in a time shared mode in which a time slot is allotted to each actuated keyswitch. The Fourier transform calculation uses the assigned frequency numbers to compute a series of waveshape data values. The component waveshapes generated during each of the time slots are summed to form the successive waveshape points for a composite waveform corresponding to all the actuated keyswitches.

The note detect and assignor 131 operates in the manner previously described and furnishes key actuation and address information to the octave interval detect 150. The details of the octave interval detect are shown in FIG. 1. They comprise all the system elements in FIG. 1 with the exception of the note detect and assignor 131.

The details of the phase initial set 151 are shown in FIG. 3 in which the set of adder-accumulators 120–122 are now replaced by the equivalent note interval adder 255 A and B.

Although not shown explicitly in FIG. 4, a random number generator can be used in a manner analogous to that shown in FIG. 2 to introduce a random frequency error in response to the CONTROL signal created by the flip-flop 104 contained in the Octave Interval Detect 150.

We claim:

1. In combination with a keyboard operated musical instrument having a keyboard containing a plurality of keyswitches and having a plurality of tone generators each operated at a musical frequency determined by a frequency number selected in response to an actuated keyswitch and wherein each one of said plurality of tone generators generates a musical waveshape, apparatus for initializing the starting phase of a generated musical waveshape comprising;

a frequency number memory means storing a table of frequency numbers, a detection means for scanning said plurality of keyswitches in a sequence of keyswitch scans wherein a detection signal is generated for each actuated keyswitch, a frequency addressing means for accessing a frequency number from said frequency memory means in response to said detection signal, a plurality of tone generators each of which generates a musical waveshape and wherein each one of said plurality of tone generators comprises:

a waveshape memory containing a set of data values corresponding to points comprising said musical waveshape, a waveshape addressing means responsive to a frequency number accessed from said frequency number means whereby data values from said set of data values are read out of said waveshape memory, and a signal conversion means whereby said data values read out of said waveshape memory are converted to generate said musical waveform, an assignor means responsive to said detection signal whereby a frequency number accessed from said frequency number memory means is assigned to one of said plurality of tone generators, a note interval detection means responsive to said detection signal whereby a control signal is generated if the frequency number accessed from said frequency number memory means differs by a preselected ratio from a frequency number assigned to any other one of said plurality of tone generators, and a phase initializing means responsive to said control signal and interposed between said frequency number memory means and said assignor means whereby if said control signal is generated the waveshape produced by the tone generator assigned the corresponding said frequency number is phase initialized by causing said associated waveshape addressing means to start addressing data values at a memory address equal to the current memory address of the waveshape addressing means corresponding to one of said plurality of tone generators having an assigned frequency number differing by said preselected ratio thereby causing said tone generator assigned said corresponding said frequency number to generate a musical waveshape having a starting waveshape phase corresponding to the current waveshape phase of a musical waveshape generated by one of said plurality of tone generators having an assigned frequency number differing by said preselected ratio.

2. Apparatus according to claim 1 wherein said detection means comprises an encoding means whereby said detection signal is encoded to identify each said actuated keyswitch.

3. Apparatus according to claim 2 wherein said assignor means comprises;

an assignor memory means, and a decoding means for decoding said encoded detection signal to generate a frequency memory address number associated with a corresponding actuated keyswitch and for storing said generated frequency memory address number in said assignor memory means.

4. Apparatus according to claim 3 wherein said frequency addressing means comprises;

a first memory addressing means for sequentially accessing each said frequency memory address number from said assignor memory means, and a second memory addressing means responsive to each said accessed frequency memory address number from said assignor memory means whereby a corresponding frequency number is accessed from said frequency number memory means.

5. Apparatus according to claim 4 wherein said note interval detection means comprises;

a comparator means wherein said control signal is generated if said frequency memory address generated by said decoding means differs by a number corresponding to said preselected ratio from any frequency memory address number accessed from said assignor memory means, a first address memory means, a second address memory means, and a third memory addressing means whereby in response to said control signal said frequency memory address generated by said decoding means is stored in said first address memory means to form a first frequency memory address and a corresponding memory address number accessed from said assignor memory means is stored in said second address memory means to form a second frequency memory address.

6. In combination with a keyboard operated musical instrument having a keyboard containing a plurality of keyswitches and having a plurality of tone generators each operated at a musical frequency determined by a frequency number selected in response to an actuated keyswitch and wherein each one of said plurality of tone generators generates a musical waveshape, apparatus for initializing the starting phase of a generated musical waveshape comprising;

a frequency number memory means storing a table of frequency numbers, a detection means for scanning said plurality of keyswitches in a sequence of keyswitch scans wherein a detection signal is generated for each actuated keyswitch, and wherein said detection signal is encoded to identify each said actuated keyswitch an assignor memory means, a decoding means for decoding said encoded detection signal to generate a frequency memory address number associated with a corresponding acuated keyswitch and for storing said generated frequency memory address number in said assignor memory means, a first memory addressing means for sequentially accessing each said frequency memory address number from said assignor memory means, a second memory addressing means responsive to each frequency memory address number accessed from said assignor memory means whereby a corresponding frequency number is accessed from said frequency number memory means, a comparator means wherein a control signal is generated if said frequency memory address generated by said decoding means differs by a preselected ratio from any frequency memory address number accessed from said assignor memory means, a first address memory means, a second address memory means, a third memory addressing means whereby in response to said control signal said frequency memory address generated by said decoding means is stored in said first address memory means to form a first memory address and a corresponding memory address number is accessed from said assignor memory means and is stored in said second address memory means to form a second frequency memory address, a plurality of tone generators each of which generates a musical waveshape at a frequency determined by a frequency number accessed from said frequency number means and wherein each of said plurality of tone generators has a waveshape memory containing a set of data values corresponding to points comprising said musical waveshape, an assignor means responsive to said encoded detection signal whereby a frequency number accessed from said frequency number memory means is assigned to one of said plurality of tone generators, a plurality of adder-accumulator means each of which is associated with a corresponding one of said plurality of tone generators wherein said frequency number assigned by said assignor means is repetively added to the contents of the corresponding adder-accumulator means to form an accumulator sum value, a plurality of waveshape addressing means each of which is associated with one of said plurality of tone generators whereby data values are read out of each said associated waveshape memory, a signal conversion means wherein the data values read out of each said associated waveshape memory in said plurality of tone generators are converted to generate said musical waveform, and a phase initializing means responsive to said control signal and interposed between said frequency number memory means and said assignor means whereby if said control signal is generated the waveshape produced by the tone generator assigned the corresponding said frequency number is initialized by causing it to generate a musical waveshape having a starting phase corresponding to the current waveshape phase of a musical waveshape generated by one of said plurality of tone generators having an assigned frequency number differing by said preselected ratio.

7. Apparatus according to claim 6 wherein said phase initializer means comprises;

a first data select means responsive to the second frequency memory address stored in said second address memory means whereby an accumulator sum value is selected from a corresponding adder-accumulator means contained in said plurality of tone generators, and a second data select means responsive to the first frequency memory address stored in said first address memory means whereby the accumulator sum value selected by said first data select means replaces the accumulator sum value in an adder-accumulator means corresponding to said first frequency memory address stored in response to said control signal thereby initializing the starting phase of the corresponding tone generator.

8. Apparatus according to claim 4 wherein said frequency addressing means further comprises;

a random number generator for generating a random number, and an adder responsive to said control signal wherein said random number is added to said frequency number accessed from said frequency number memory means.

9. In combination with a keyboard operated musical instrument having a keyboard containing a plurality of keyswitches in which a series of data values corresponding to the sample points of a composite musical waveform corresponding to a number of actuated keyswitches are generated at equal real time intervals by a discrete Fourier transform computation, apparatus for initializing the starting phase component of the composite musical waveform corresponding to a newly actuated keyswitch comprising;

a frequency number memory means storing a table of frequency numbers, a detection means for scanning said plurality of keyswitches in a sequence of keyswitch scans wherein a detection signal is generated for each actuated keyswitch, a frequency addressing means for accessing a frequency number from said frequency memory means in response to said detection signal, a tone generator comprising a plurality of component waveshape generators each of which creates a component musical waveshape using said Fourier transform computation having a fundamental frequency component corresponding to a frequency number accessed from said frequency memory means, an assignor means responsive to said detection signal whereby a frequency number accessed from said frequency number memory means is assigned to one of said plurality of component waveshape generators, a note interval detection means responsive to said detection signal whereby a control signal is generated if the frequency number accessed from said frequency number means differs by a preselected ratio from a frequency number assigned to any other one of said plurality of component waveshape generators, a phase initializer means responsive to said control signal and interposed between said frequency number memory means and said assignor means whereby if said control signal is generated the waveshape produced by the component waveshape generator assigned the corresponding said frequency number is phase initialized causing it to generate a first component musical waveshape having a starting phase corresponding to the current waveshape phase of a component musical waveshape generated by one of said plurality of a second component waveshape generator having an assigned frequency number differing by said preselected ratio, and a signal conversion means wherein each of said component musical waveshapes generated by said tone generator are combined to create said composite musical waveshape.

10. Apparatus according to claim 9 wherein said tone generator comprises;

a means for computing a discrete Fourier transform responsive to each said assigned frequency number whereby said series of data values are generated corresponding to said sample points of a composite musical waveshape.

* * * * *